US009638011B2

(12) United States Patent
Cleveland et al.

(10) Patent No.: US 9,638,011 B2
(45) Date of Patent: May 2, 2017

(54) SYSTEM AND METHOD FOR ACTUATING DOWNHOLE PACKERS

(71) Applicant: Schlumberger Technology Corporation, Sugar Land, TX (US)

(72) Inventors: Daniel Cleveland, Pearland, TX (US); Oscar V. Rodriguez, League City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 278 days.

(21) Appl. No.: 14/452,600

(22) Filed: Aug. 6, 2014

(65) Prior Publication Data

US 2015/0041130 A1 Feb. 12, 2015

Related U.S. Application Data

(60) Provisional application No. 61/863,099, filed on Aug. 7, 2013, provisional application No. 61/927,113, filed on Jan. 14, 2014.

(51) Int. Cl.

| | |
|---|---|
| ***E21B 43/04*** | (2006.01) |
| ***E21B 23/06*** | (2006.01) |
| ***E21B 33/124*** | (2006.01) |

(52) U.S. Cl.

CPC ..... *E21B 43/04* (2013.01); *E21B 23/06* (2013.01); *E21B 33/124* (2013.01)

(58) Field of Classification Search

USPC ..... 166/278, 276, 51

See application file for complete search history.

(56) References Cited

U.S. PATENT DOCUMENTS

| | | | | |
|---|---|---|---|---|
| 1,734,040 A | | 1/1927 | McEvoy | |
| 4,407,363 A | | 10/1983 | Akkerman | |
| 4,832,120 A | | 5/1989 | Coronado | |
| 5,458,194 A | * | 10/1995 | Brooks | E21B 33/127 166/285 |
| 5,588,487 A | | 12/1996 | Bryant | |

(Continued)

FOREIGN PATENT DOCUMENTS

WO 2012/082303 A2 6/2012

OTHER PUBLICATIONS

International Search Report and Written Opinion issued in PCT/US2014/050024 on Nov. 19, 2014, 10 pages.

(Continued)

*Primary Examiner* — Taras P Bemko

(74) *Attorney, Agent, or Firm* — Jeffery R. Peterson

(57) ABSTRACT

A downhole tool includes an outer tubular member and an inner tubular member. The outer tubular member may have one or more screens coupled thereto, a packer coupled thereto, and a shunt tube isolation valve coupled thereto. A first sleeve may be coupled to the packer and move from a first position to a second position. The packer may actuate into a set state when the first sleeve is moved to the second position, and the packer may isolate first and second portions of an annulus from one another when in the set state. A shunt tube may be coupled to the packer and provide a path of fluid communication from the first portion of the annulus, through the packer, and to the second portion of the annulus when the packer is in the set state.

13 Claims, 10 Drawing Sheets

(56) References Cited

U.S. PATENT DOCUMENTS

| | | | | |
|---|---|---|---|---|
| 6,298,916 | B1 * | 10/2001 | Tibbles | E21B 34/14 166/145 |
| 6,446,729 | B1 | 9/2002 | Bixenman et al. | |
| 6,575,251 | B2 | 6/2003 | Watson et al. | |
| 6,588,506 | B2 | 7/2003 | Jones | |
| 6,640,893 | B1 | 11/2003 | Rummel et al. | |
| 6,752,205 | B2 | 6/2004 | Kutac et al. | |
| 6,988,557 | B2 | 1/2006 | Whanger et al. | |
| 7,347,274 | B2 | 3/2008 | Patel et al. | |
| 7,591,321 | B2 | 9/2009 | Whitsitt et al. | |
| 7,784,532 | B2 | 8/2010 | Sevre et al. | |
| 8,196,652 | B2 | 6/2012 | Brisco et al. | |
| 2003/0098153 | A1 | 5/2003 | Serafin | |
| 2006/0095240 | A1 | 5/2006 | Elisabeth et al. | |
| 2007/0044962 | A1 | 3/2007 | Tibbles | |
| 2008/0314589 | A1 | 12/2008 | Guignard et al. | |
| 2009/0283279 | A1 | 11/2009 | Patel | |
| 2010/0236775 | A1 | 9/2010 | Sevre et al. | |
| 2011/0240290 | A1 | 10/2011 | Jasek et al. | |

OTHER PUBLICATIONS

European Search Report for corresponding European Application Serial No. EP14834693, dated Feb. 24, 2017, 10 pages.

* cited by examiner

SYSTEM AND METHOD FOR ACTUATING DOWNHOLE PACKERS

CROSS-REFERENCE TO RELATED APPLICATIONS

This application claims the benefit of U.S. Provisional Patent Application having Ser. No. 61/863,099, filed Aug. 7, 2013, entitled "System and Method for Actuating Downhole Packers,", and U.S. Provisional Patent Application having Ser. No. 61/927,113, filed Jan. 14, 2014, entitled "System and Method for Actuating Downhole Packers". The entirety of both provisional applications is incorporated herein by reference in their entirety.

BACKGROUND

Embodiments described herein generally relate to a system and method for gravel packing a wellbore. More particularly, embodiments described herein relate to a system and method for actuating a plurality of packers prior to gravel packing an annulus formed between a completion assembly and a wall of the wellbore.

Hydrocarbons produced from a subterranean formation oftentimes have sand or other particulates disposed therein. As the sand is undesirable to produce, many techniques exist for reducing the sand content in the hydrocarbons. Gravel packing is one technique used to filter and separate the sand from the hydrocarbons in a wellbore. Gravel packing generally involves pumping a gravel slurry, including gravel dispersed within a carrier fluid, down a work string and into the annulus formed between a completion assembly and the wall of the wellbore. The gravel is used to filter and separate the sand from the hydrocarbons as the hydrocarbons flow from the formation, into a completion assembly, and up to the surface.

One or more packers are oftentimes set or actuated prior to gravel packing. Upon actuation, the packers expand radially-outward into contact with the wall of the wellbore to isolate different layers or zones of the formation. Isolating the different zones prevents the cross-flow of fluids (e.g., hydrocarbon fluids such as oil or gas) between the different zones and reduces the amount of water produced from the formation. One type of packer that is commonly used is a swellable packer that actuates when placed in contact with a catalyst. Swellable packers, however, may take days or weeks to fully actuate and isolate the different zones. Another type of packer is actuated by dropping a ball into the work string until the ball comes to rest on a ball seat proximate the packer. The hydraulic pressure of the fluid within the work string is then increased from the surface to actuate the packer. The increased pressure places the work string and components coupled thereto under strain, which may eventually lead to failure.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A downhole tool is disclosed. The downhole tool may include an outer tubular member having screens coupled thereto. A packer may be coupled to the outer tubular member. A first sleeve may be coupled to the packer and move from a first position to a second position. The packer may actuate into a set state when the first sleeve is moved to the second position, and the packer isolates first and second portions of an annulus from one another when in the set state. A shunt tube may be coupled to the packer and provide a path of fluid communication from the first portion of the annulus, through the packer, and to the second portion of the annulus when the packer is in the set state. A shunt tube isolation valve may be coupled to outer tubular member and the shunt tube. A second sleeve may be coupled to the shunt tube isolation valve and move from a first position to a second position. The shunt tube isolation valve may block the path of fluid communication from the first portion of the annulus to the second portion of the annulus when the second sleeve is in the second position. An inner tubular member may be disposed radially-inward from the outer tubular member. A first shifting tool may be coupled to the inner tubular member and engage and move the first sleeve from the first position to the second position. A second shifting tool may be coupled to the inner tubular member and engage and move the second sleeve from the first position to the second position.

A method for gravel packing a wellbore in a single trip is also disclosed. The method may include deploying a downhole tool into the wellbore. The downhole tool may include an outer tubular member having screens coupled thereto, a plurality of packers, a plurality of first sleeves, an inner tubular member, and a plurality of first shifting tools. The inner tubular member may be moved in a first axial direction with respect to the outer tubular member. The first shifting tools may contact a restriction in response to the movement in the first direction, and the first shifting tools may actuate from a deactivated state to an activated state in response to the contact. The inner tubular member may move in a second, opposing axial direction with respect to the outer tubular member after the first shifting tools are actuated into the activated state. The first shifting tools may engage and move the first sleeves from a first position to a second position in response to the movement in the second direction. The packers may actuate from an unset state to a set state when the first sleeves move into the second position, and a first one of the packers may isolate first and second portions of an annulus from one another when in the set state. A treatment may be pumped into the first portion of the annulus after the packers are actuated into the set state.

A shifting tool is also disclosed. The shifting tool may include an inner body defining a recess therein. A tubular sleeve may be positioned radially-outward from the inner body and have an opening formed radially therethrough. An activation collet may be positioned radially-between the inner body and the sleeve. The activation collet may include a collet finger that extends radially-outward therefrom and through the opening in the sleeve. A shifting member may be held in a first position by the sleeve, and the shifting member may move to a second position in response to the sleeve moving with respect to the inner body.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1:
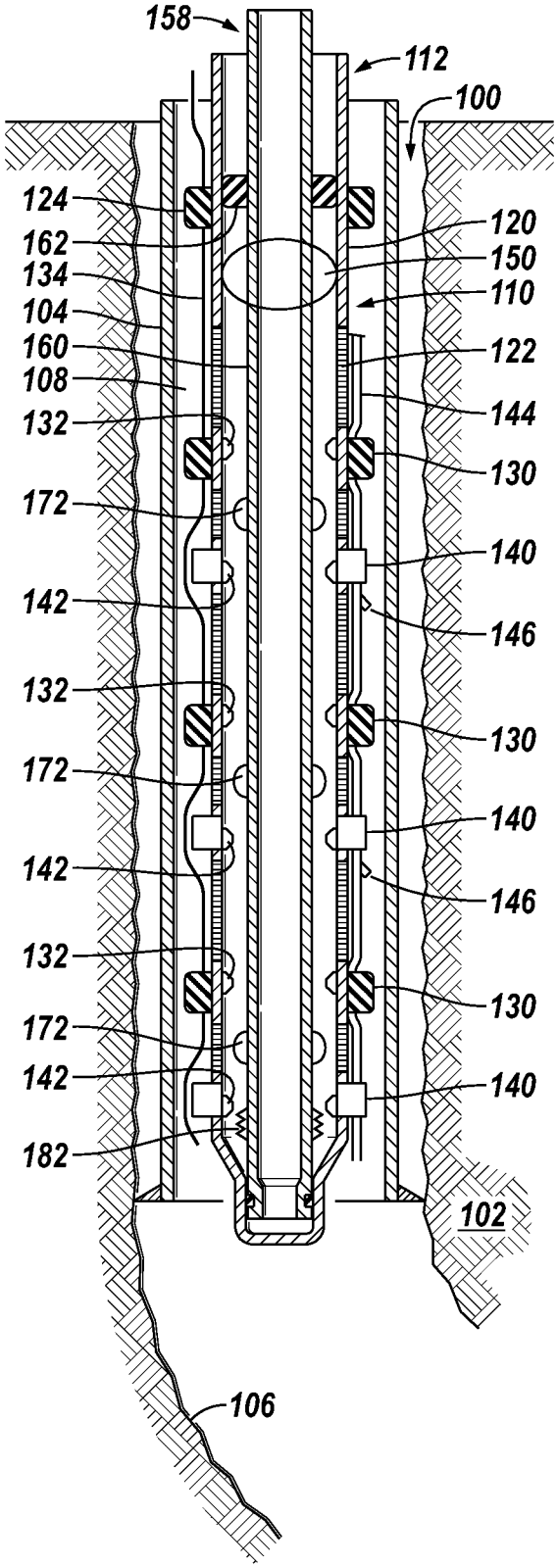
FIG. 1 depicts a schematic cross-sectional view of an illustrative downhole tool being run into a wellbore, according to one or more embodiments disclosed.

FIG. 1 depicts a schematic cross-sectional view of an illustrative downhole tool 110 being run into a wellbore 100, according to one or more embodiments. The downhole tool 110 may be run into a wellbore 100 formed in a subterranean formation 102. The downhole tool 110 may include a first or "outer" tubular member 120 and a second or "inner" tubular member 160. The outer tubular member 120 may be or include a completion assembly, and the inner tubular member 160 may be or include a wash pipe. An annulus 108 may be formed between the outer tubular member 120 and a casing 104 in the wellbore 100 or a wall 106 of the wellbore 100.

The outer tubular member 120 may have one or more screens 122 coupled thereto or disposed therein. The screens 122 may be circumferentially and/or axially offset from one another. The screens 122 may provide a path of fluid communication from the annulus 108 to an interior of the outer tubular member 120. More particularly, the screens 122 may be adapted have fluid flow therethrough and to the interior of the outer tubular member 120 while preventing particulates (e.g., sand and gravel) disposed in the fluid from flowing therethrough and to the interior of the outer tubular member 120.

A gravel pack packer 124 may be coupled to the outer tubular member 120 proximate an upper end portion thereof. The gravel pack packer 124 may actuate from a first or "unset" state to a second or "set" state. The gravel pack packer 124 expands radially-outward and anchors the outer tubular member 120 against the casing 104 when in the set state, as described in more detail with reference to FIG. 2.

One or more zonal isolation packers 130 (three are shown) may be coupled to the outer tubular member 120 and positioned below the gravel pack packer 124. The zonal isolation packers 130 may be axially offset from one another along the outer tubular member 120 from about 1 m to about 5 m, about 5 m to about 25 m, about 25 m to about 50 m, about 50 m to about 100 m, about 100 m to about 250 m, about 250 m to about 500 m, or more. Each pair of adjacent zonal isolation packers 130 may have at least one screen 122 positioned therebetween.

Each zonal isolation packer 130 may have a sleeve 132 coupled thereto that is accessible from an interior of the outer tubular member 120. The sleeves 132 may be moveable from a first position to a second position. The first position may be axially and/or circumferentially offset from the second position. The zonal isolation packers 130 may be in a first or "unset" state when the sleeve 132 is in the first position. The zonal isolation packers 130 actuate into a second or "set" state when the sleeve 132 is moved to the second position. The zonal isolation packers 130 expand radially-outward into contact with a wall 106 of the wellbore 100 when in the set state. As such, each zonal isolation packer 130 may isolate a first or "upper" portion of the annulus 108 from a second or "lower" portion of the annulus 108, as described in more detail below.

The zonal isolation packers 130 may have one or more bypass ports or openings formed axially therethrough. The openings may provide a path of fluid communication through the zonal isolation packers 130 (i.e., between the upper and lower portions of the annulus 108) when the zonal isolation packers 130 are in the set state. One or more control lines 134 may be coupled to and positioned radially-outward from the outer tubular member 120. The control lines 134 may extend through the openings in the zonal isolation packers 130.

One or more shunt tubes 144 may be coupled to the zonal isolation packers 130. More particularly, the shunt tubes 144 may extend through the openings in the zonal isolation packers 130. The shunt tubes 144 may provide a path of fluid communication through the zonal isolation packer 130 (i.e., between the upper and lower portions of the annulus 108) when the zonal isolation packers 130 are in the set state. As described in greater detail below, a gravel slurry or other treatment fluid may flow through the shunt tubes 144 and into the annulus 108 after the zonal isolation packers 130 are actuated into the set state. The shunt tubes 144 may have one or more openings or outlets 146 through which the gravel slurry or other treatment fluid may flow into the annulus 108.

One or more shunt tube isolation valves 140 may be coupled to the outer tubular member 120 and the shunt tubes 144. At least one shunt tube isolation valve 140 may be disposed between each pair of adjacent zonal isolation packers 130. Each shunt tube isolation valve 140 may have one or more of the shunt tubes 144 coupled thereto and/or extending therethrough such that a path of fluid communication exists therethrough.

Each shunt tube isolation valve 140 may have a sleeve 142 coupled thereto that is accessible from an interior of the outer tubular member 120. The sleeves 142 may be moveable from a first position to a second position. The first position may be axially and/or circumferentially offset from the second position. The shunt tube isolation valves 140 may be in a first or "open" state when the sleeve 142 is in the first position. The shunt tube isolation valves 140 may permit the gravel slurry or other treatment fluid to flow therethrough when in the open state. The shunt tube isolation valves 140 actuate into a second or "closed" state when the sleeve 142 is moved to the second position. The shunt tube isolation valves 140 may block or obstruct the path of fluid communication through the shunt tubes 144 when in the closed position. As such, the gravel slurry or other treatment fluid may no longer flow through the shunt tubes 144 between the upper and lower portions of the annulus 108.

A formation isolation valve ("FIV") 150 may be coupled to the outer tubular member 120. The formation isolation valve 150 may actuate from a first or "open" state to a second or "closed" state. The formation isolation valve 150 may permit fluid flow in both axial directions through the outer tubular member 120 when in the open state, and the formation isolation valve 150 may block or obstruct fluid flow in both axial directions through the outer tubular member 120 when in the closed state.

The inner tubular member 160 may be disposed radially-inward from the outer tubular member 120. The inner tubular member 160 may have a gravel pack packer shifting tool 162 coupled thereto that is adapted to engage and actuate the gravel pack packer 124 from the unset state to the set state.

The inner tubular member 160 may also have one or more zonal isolation packer activation collets or tools (not shown) and one or more zonal isolation packer shifting collets or tools 172 coupled thereto. The zonal isolation packer activation tools may actuate the zonal isolation packer shifting tools 172 from a first or "deactivated" state to a second or "activated" state. The zonal isolation packer shifting tools 172 may move axially past corresponding sleeves 132 in the zonal isolation packers 130 without engaging and moving the sleeves 132 when the zonal isolation packer shifting tools 172 are in the deactivated state. The zonal isolation packer shifting tools 172 may engage and move the sleeves 132 when the zonal isolation packer shifting tools 172 are in the activated state. For example, the zonal isolation packer shifting tools 172 may engage and move the sleeves 132 of the zonal isolation packers 130 from the first position to the second position, thereby actuating the zonal isolation packers 130 into the set state.

The distance between the zonal isolation packer shifting tools 172 may be the same or substantially the same as the distance between zonal isolation packers 130 such that the zonal isolation packer shifting tools 172 may be aligned with the zonal isolation packers 130. As such, the zonal isolation packer shifting tools 172 may actuate the zonal isolation packers 130 substantially simultaneously. Additionally, the zonal isolation packer shifting tools 172 may actuate the zonal isolation packers 130 in less than 10 minutes, less than five minutes, or less than one minute. Such actuation is effectively instantaneous as compared to previous systems in which the swell packers or other packers were actuated over days or even weeks.

The inner tubular member 160 may also have a formation isolation valve shifting tool 182 coupled thereto and positioned below the zonal isolation valve shifting tools 172. The formation isolation valve shifting tool 182 may engage and actuate the formation isolation valve 150 from the open state to the closed state.

In at least one embodiment, the formation isolation valve shifting tool 182 may also engage and move the sleeves 142 of the shunt tube isolation valves 140. For example, the formation isolation valve shifting tool 182 may engage and move the sleeves 142 of the shunt tube isolation valves 140 from the first position to the second position, thereby actuating the shunt tube isolation valves 140 into the closed state. In another embodiment, the inner tubular member 160 may include a separate shifting tool (not shown) that is adapted to engage and move the sleeves 142 of the shunt tube isolation valves 140.

FIGS. 1-6 illustrate the operation of the downhole tool 110 in the wellbore 100. The outer tubular member 120 may be run into the wellbore 100 and hung from the rig floor at the surface. The inner tubular member 160 may be run into the outer tubular member 120 and stabbed into the lower end portion of the outer tubular member 120. The zonal isolation packer activation tools may be pushed upward and inward to allow the zonal isolation packer activation tools to pass through the inner diameter of the outer tubular member 120. At this point, the gravel pack packer 124 may be unset, the zonal isolation packers 130 may be unset, the shunt tube isolation valves 140 may be open, and the formation isolation valve 150 may be open. In addition, the zonal isolation packer shifting tools 172 may be in the deactivated state.

Figure 2:
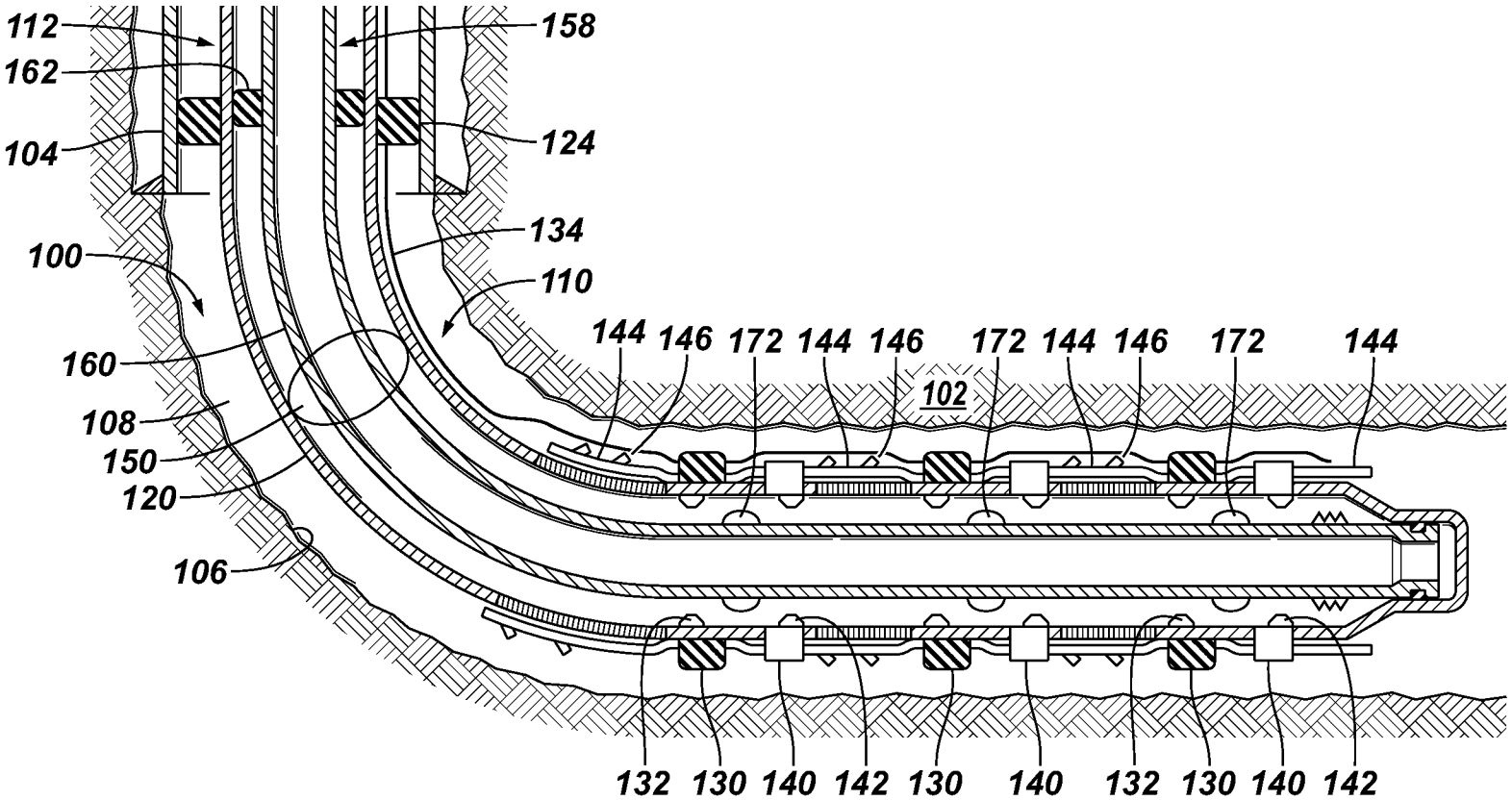
FIG. 2 depicts a schematic cross-sectional view of the downhole tool after the gravel pack packer is set, according to one or more embodiments disclosed.

FIG. 2 depicts a schematic cross-sectional view of the downhole tool 110 after the gravel pack packer 124 is set, according to one or more embodiments. The downhole tool 110 may be run into the wellbore 100 to the desired depth or location, which may be in a vertical, deviated, or horizontal portion of the wellbore 100. When the downhole tool 110 is positioned at the desired location, the inner tubular member 160 may be moved axially with respect to the outer tubular member 120 such that the gravel pack packer shifting tool 162 engages and actuates the gravel pack packer 124 into the set state. This causes the gravel pack packer 124 to expand radially-outward and to anchor the downhole tool 110 against the casing 104.

Figure 3:
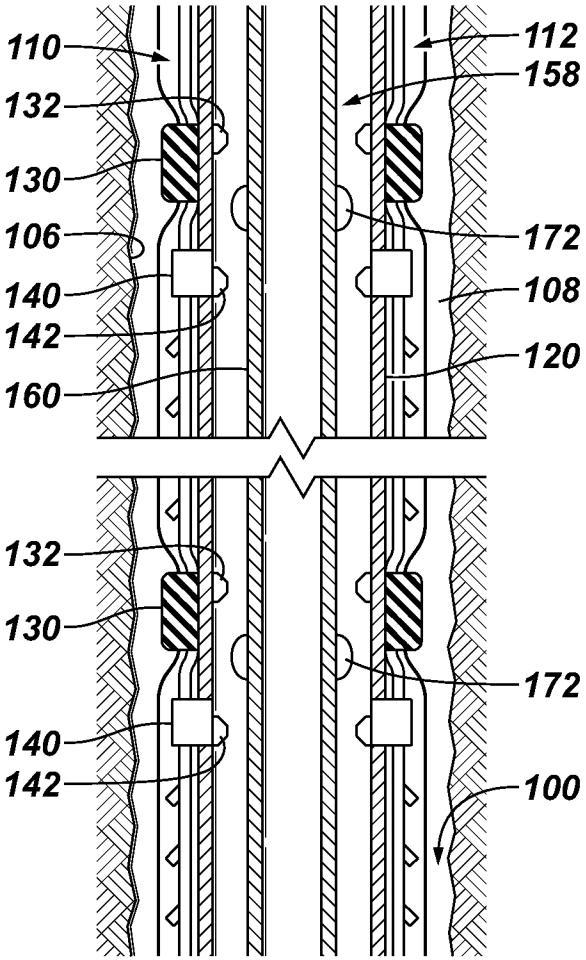
FIG. 3 depicts an enlarged schematic cross-sectional view of a portion of the downhole tool when the downhole tool is positioned at the desired location in the wellbore, according to one or more embodiments disclosed.

FIG. 3 depicts a schematic cross-sectional view of a portion of the downhole tool 110 when the downhole tool 110 is positioned at the desired location in the wellbore 100, according to one or more embodiments. Once the gravel pack packer 124 is set, the inner tubular member 160 may be positioned such that each zonal isolation packer activation tool and/or each zonal isolation packer shifting tool 172 is axially offset from (e.g., below) a corresponding zonal isolation packer 130 from about 1 m to about 10 m. The inner tubular member 160 may then be moved axially in a first direction (e.g., upward) from about 1 m to about 10 m with respect to the outer tubular member 120.

Figure 4:
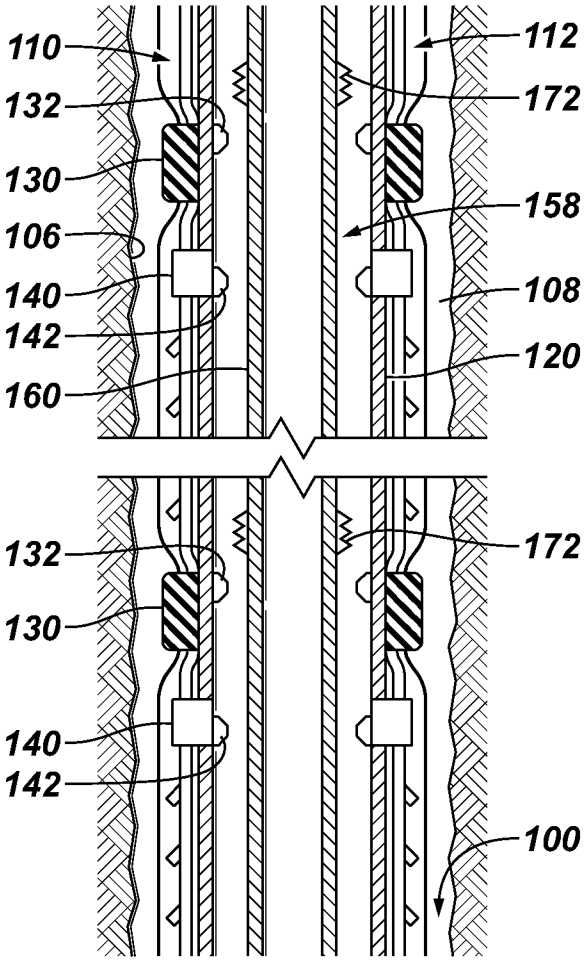
FIG. 4 depicts a schematic cross-sectional view of the portion of the downhole tool when the shifting tools on the inner tubular member are activated, according to one or more embodiments disclosed.

FIG. 4 depicts a schematic cross-sectional view of the portion of the downhole tool 110 when the zonal isolation packer shifting tools 172 on the inner tubular member 160 are activated, according to one or more embodiments. The upward movement of the inner tubular member 160 may cause the zonal isolation packer activation tools to pass through and contact a restriction or obstruction on the inner surface of the outer tubular member 120. The restriction may be or include the zonal isolation packers 130, the sleeves 132 coupled thereto, or any other area of reduced diameter within the outer tubular member 120. The contact may cause the zonal isolate packer activation tools to deflect inward.

While the engagement of the zonal isolation packer activation tools with the zonal isolation packers 130 has decreased, the engagement of the zonal isolation packer activation tools with a windowed housing (not shown) has increased. The contact exerts a force by compressing a spring (not shown). The force may be exerted to the zonal isolation packer activation tools by the contact with the windowed housing. The stored energy in the spring may be used to collapse the zonal isolation packer activation tools into corresponding grooves such that the outer diameter of the zonal isolation packer activation tools is less than the outer diameter of the centralizer of the windowed housing. Therefore, the force exerted by the spring may tuck the zonal isolation packer activation tools to an outer diameter value less than the smallest inner diameter of the outer tubular member 120. This may cause the zonal isolation packer shifting tools 172 to be pulled out from underneath a deactivation sleeve (not shown) such that it is able to expand outward into the activated state.

At this point, the inner tubular member 160 may be pulled out of the outer tubular member 120 without actuating the zonal isolation packers 130 into the set state. This may permit an operator at the surface to pull the inner tubular member 160 and/or the outer tubular member 120 out of the wellbore 100 if either member 120, 160 is not properly run into the wellbore 100 (e.g., if the outer tubular member 120 becomes stuck or if the spacing between the inner and outer tubular members 120, 160 is not as desired).

Figure 5:
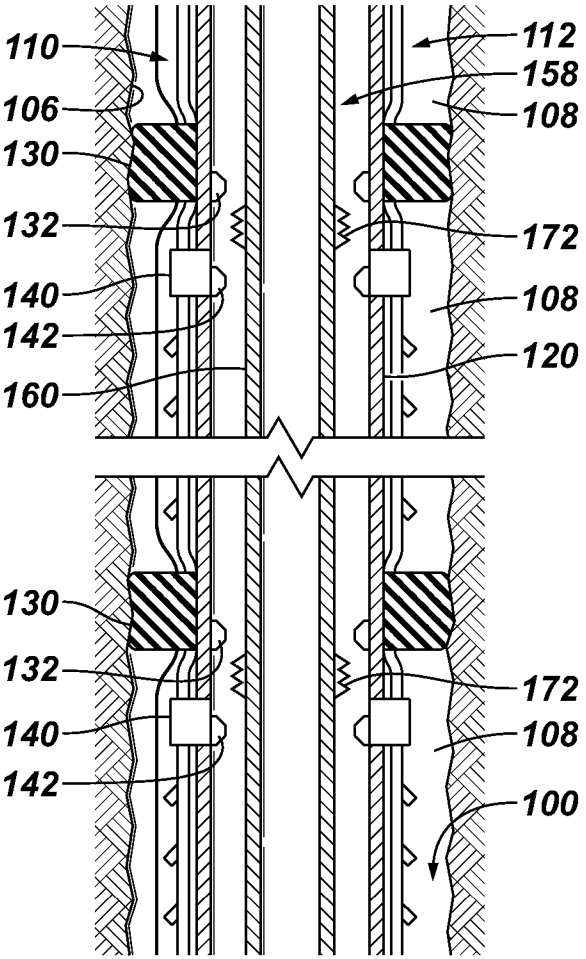
FIG. 5 depicts a schematic cross-sectional view of the portion of the downhole tool as the zonal isolation packer shifting tools actuate the zonal isolation packers into the set state, according to one or more embodiments disclosed.

FIG. 5 depicts a schematic cross-sectional view of the portion of the downhole tool 110 as the zonal isolation packer shifting tools 172 actuate the zonal isolation packers 130 into the set state, according to one or more embodiments. Once the zonal isolation packer shifting tools 172 have been activated, the inner tubular member 160 may be moved in a second, opposing direction (e.g., downward) from about 1 m to about 10 m. The (now activated) zonal isolation packer shifting tools 172 may engage the sleeves 132. The force exerted by the zonal isolation packer shifting tools 172 may cause one or more shear elements (e.g., shear screws) to break such that the sleeves 132 move from the first position to the second position.

Figure 8:
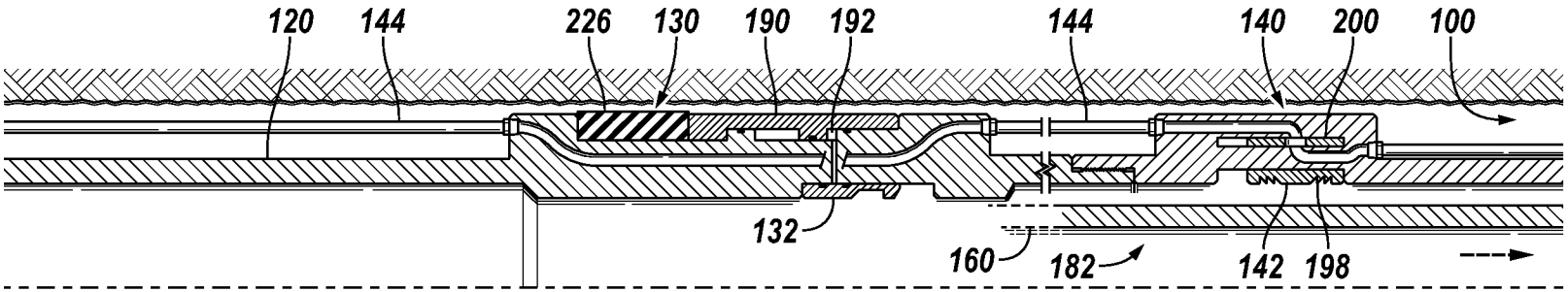

Once the sleeves 132 are moved to the second position, the hydrostatic pressure of the fluid in the wellbore 100 may cause the zonal isolation packers 130 to actuate into the set state. More particularly, the hydrostatic pressure of the fluid may act against a chamber having a fluid disposed therein at substantially atmospheric pressure. For example, the pressure of the fluid in the chamber may be from about 50 kPa to about 200 kPa. The pressure acting against the chamber may cause a piston in the chamber to stroke, which actuates the zonal isolation packers 130 into the set state. When in the set state, the zonal isolation packers 130 expand radially-outward into contact with the wall 106 of the wellbore 100. As such, each zonal isolation packer 130 may isolate a portion of the annulus 108 thereabove and therebelow. As shown in FIG. 8, two zonal isolation packers 130 are in the set state and isolate three portions of the annulus 108-1, 108-2, 108-3 from one another. However, as may be appreciated, any number of zonal isolation packers 130 may be used.

Figure 6:
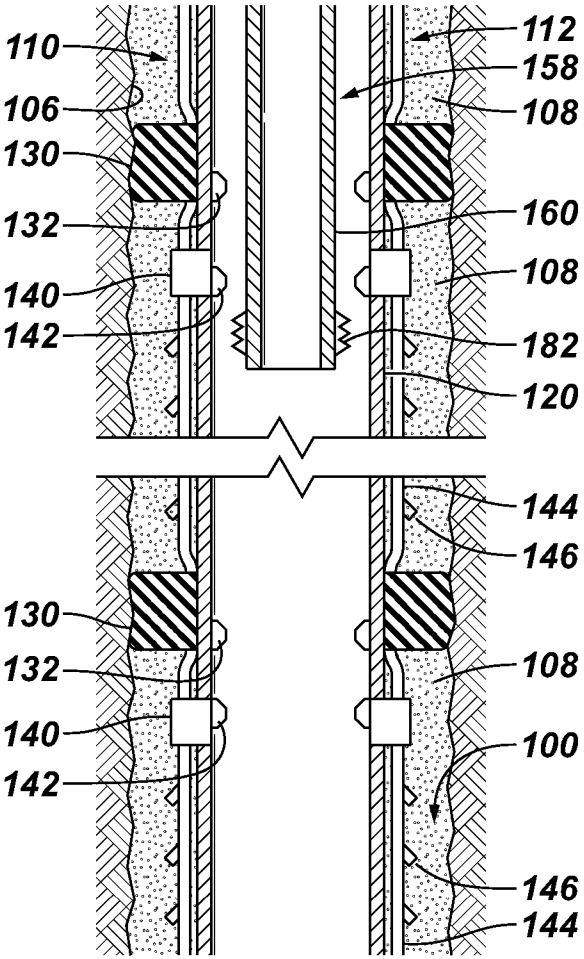
FIG. 6 depicts a schematic cross-sectional view of the portion of the downhole tool as a treatment is performed, according to one or more embodiments disclosed.

FIG. 6 depicts a schematic cross-sectional view of the portion of the downhole tool 110 as a treatment is performed, according to one or more embodiments. Once the zonal isolation packers 130-1, 130-2 are set, a treatment may be performed. The treatment may include gravel packing, acid treatment, hydraulic fracturing, or the like. As shown, a gravel slurry may be pumped into the wellbore 100. The gravel slurry may flow down through a work string (not shown) and into the first portion of the annulus 108-1. Because the zonal isolation packers 130-1, 130-2 are in the set state, the zonal isolation packers 130-1, 130-2 may prevent the gravel slurry from flowing axially therepast into the second and third portions of the annulus 108-2, 108-3.

The gravel slurry may, however, flow from the first portion of the annulus 108-1 into the second and third portions of the annulus 108-2, 108-3 via the flowpath through the shunt tubes 144 extending through the zonal isolation packers 130-1, 130-2. More particularly, the gravel slurry may flow from the first portion of the annulus 108-1, into and through the shunt tube 144 extending through the first zonal isolation packer 130-1, and into the second portion of the annulus 108-2 via the outlets 146 in the shunt tube 144. Similarly, the gravel slurry may flow from the second portion of the annulus 108-2, into and through the shunt tube 144 extending through the second zonal isolation packer 130-2, and into the third portion of the annulus 108-3 via the outlets 146 in the shunt tube 144.

The carrier fluid in the gravel slurry may flow through the screens 122 in the outer tubular member 120 and back to the surface through via the interior of the outer tubular member 120. This may leave the gravel particulates from the gravel slurry positioned in the annulus 108 between the outer tubular member 120 and the wall 106 of the wellbore 100.

Once the gravel packing process is complete, the inner tubular member 160 may again be moved in the first direction (e.g., upward) with respect to the outer tubular member 120. This may cause the formation isolation valve shifting tool 182 to pass through and contact the shunt tube isolation valves 140 and/or the sleeves 142 coupled thereto. The formation isolation valve shifting tool 182 may engage and move the sleeves 142 from the first position to the second position. When in the second position, the shunt tube isolation valves 140 actuate into the closed state and block or obstruct the path of fluid communication through the shunt tubes 144. As such, no more gravel slurry may flow through the shunt tubes 144, and the portions of the annulus 108-1, 108-2, 108-3 may be isolated from one another.

As the inner tubular member 160 continues to move toward the surface, the formation isolation valve shifting tool 182 may also engage and actuate the formation isolation valve 150 (see FIGS. 1 and 2) into the closed state such that the formation isolation valve 150 prevents fluid flow in both axial directions therethrough. Although the zonal isolation valve shifting tools 172 are in the activated state, they may not engage and actuate the zonal isolation valves 130 as the inner tubular member 160 is pulled upward toward the surface.

Thus, the zonal isolation packer shifting tools 172 may be actuated into the activated state, the zonal isolation packers 130 may be actuated into the set state, the gravel slurry may flow into the first and second portions of the annulus 108-1, 108-2, and the shunt tube isolation valves 140 may be actuated into the closed state during a single trip in the wellbore 100 with the downhole tool 110.

Figure 7:
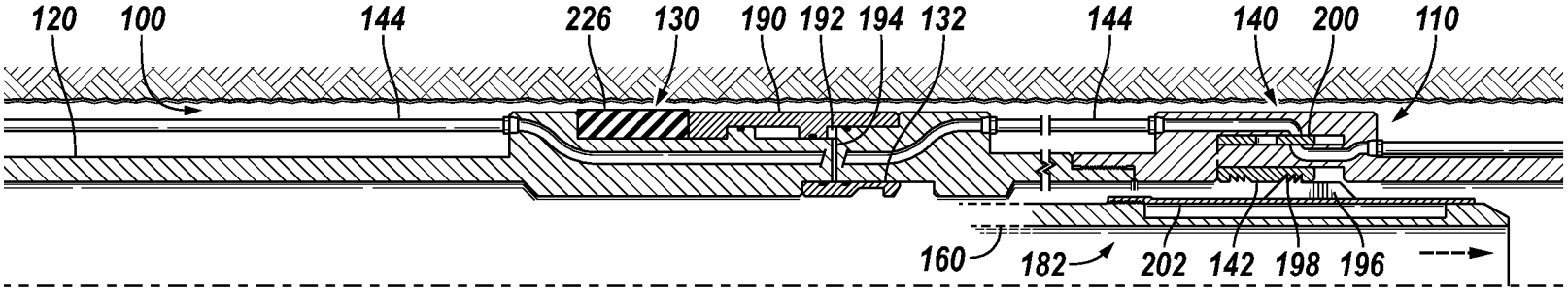
FIGS. 7 and 8 depict cross-sectional views of a portion of the downhole tool with the shunt tube isolation valve in a closed position and an open position, respectively, according to one or more embodiments disclosed.

FIGS. 7 and 8 depict cross-sectional views of a portion of the downhole tool 110 with the shunt tube isolation valve 140 in a closed position and an open position, respectively, according to one or more embodiments disclosed. The shunt tube isolation valve 140 may be actuated between an open position and a closed position via movement of the sleeve 142 coupled to the shunt tube isolation valve 140. As the inner tubular member 160 is moved downhole relative to outer tubular member 120 (e.g., to the right as shown in FIGS. 7 and 8), an engagement feature 196 on the formation isolation valve shifting tool 182 may engage a corresponding engagement feature 198 on the sleeve 142 coupled to the shunt tube isolation valve 140. The sleeve 142 may also include a valve seal member 200 which selectively opens or closes off flow through the shunt tube 144 depending on the position of the sleeve 142. The valve seal member 200 may be radially-offset from the sleeve 142. Continued, relative downward movement of the inner tubular member 160 may cause the formation isolation valve shifting tool 182 to shift the sleeve 142 from the closed position (FIG. 7) to the open position (FIG. 8). The engagement feature 196 may be mounted on a flex member 202 which allows the engagement feature 196 to bend to move radially-inward and to release from the corresponding engagement feature 198 under continued relative downward movement of the inner tubular member 160 relative to outer tubular member 120.

Figure 9:
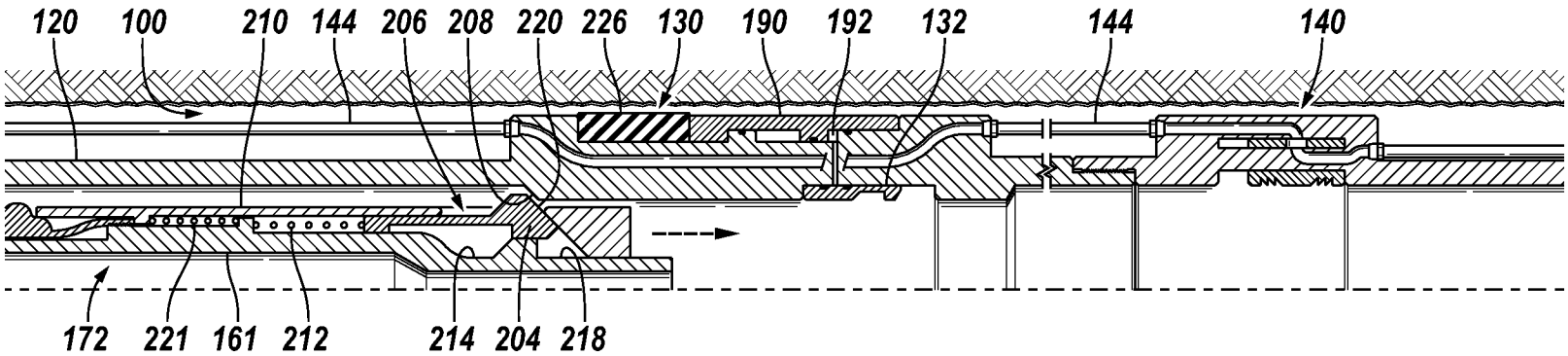
FIGS. 9 and 10 depict cross-sectional views of a portion of the downhole tool with the inner tubular member continuing to move downward with respect to the outer tubular member, according to one or more embodiments disclosed.
Figure 10:
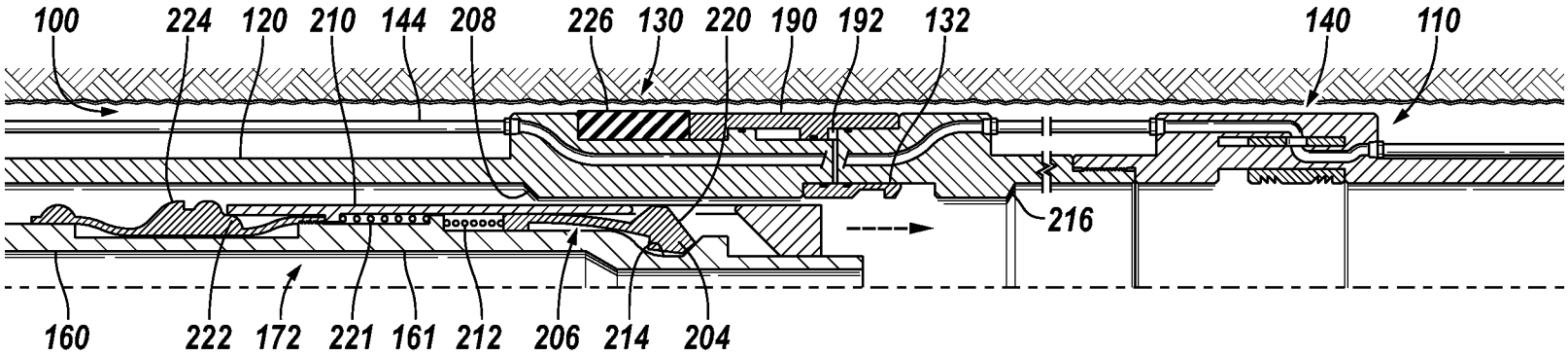

FIGS. 9 and 10 depict cross-sectional views of a portion of the downhole tool 110 with the inner tubular member 160 continuing to move downward with respect to the outer tubular member 120, according to one or more embodiments disclosed. The zonal isolation packer shifting tool 172 may be coupled to the inner tubular member 160 and configured to move through the outer tubular member 120. In FIG. 9, a portion of the outer tubular member 120 is illustrated and includes one of the zonal isolation packers 130 with a shunt tube 144 extending to one of the shunt tube isolation valves 140. As shown in FIG. 9, the sleeve 132 coupled to the zonal isolation packer 130 is blocking flow of higher pressure fluid through a port 194 and into a pressure chamber 192. As a result, the zonal isolation packer 130 is in a deactivated state.

As the inner tubular member 160 continues to move downward relative to the outer tubular member 120 (e.g., to the right as shown in FIGS. 9 and 10), one or more collet fingers 204 coupled to an activation collet 206 may engage a restriction 208 which may be positioned along an interior of the zonal isolation packer 130 or at another suitable location. The activation collet 206 may be coupled to the zonal isolation packer shifting tool 172. A portion of each collet finger 204 may extend radially-outward through an opening in a sleeve 210 (e.g. a deactivation sleeve). The activation collet 206 may be positioned radially—between the body 161 of the inner tubular member 160 and the sleeve 210.

The collet fingers 204 of the activation collet 206 may engage the restriction 208 within the isolation packer 130 as the zonal isolation packer shifting tool 172 moves downward through the zonal isolation packer 130. This contact causes axial movement of the collet 206 (e.g., relative to the inner tubular member 160), which may compress a spring member 212 located within the deactivation sleeve 210, as illustrated in FIG. 10. Consequently, each collet finger 204 may move radially-inward and into a groove or recess 214 in the body 161 of the inner tubular member 160. When the collet fingers 204 are in the radially-inward position, the first shifting tool 172 may pass down through the zonal isolation packer 130.

Figure 11:
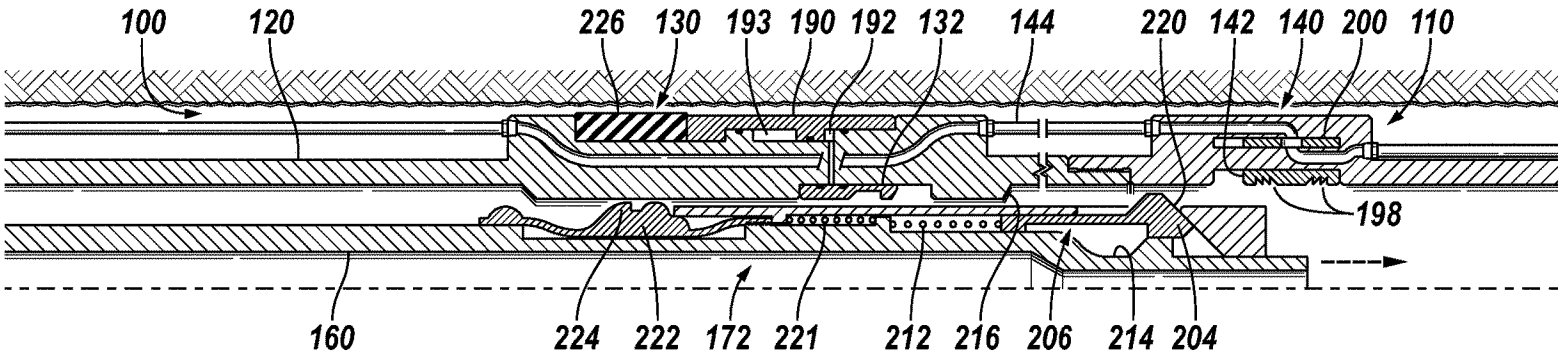
FIGS. 11 and 12 depict cross-sectional views of a portion of the downhole tool with the zonal isolation packer shifting tool shifting from a deactivated state to an activate state, according to one or more embodiments disclosed.
Figure 12:
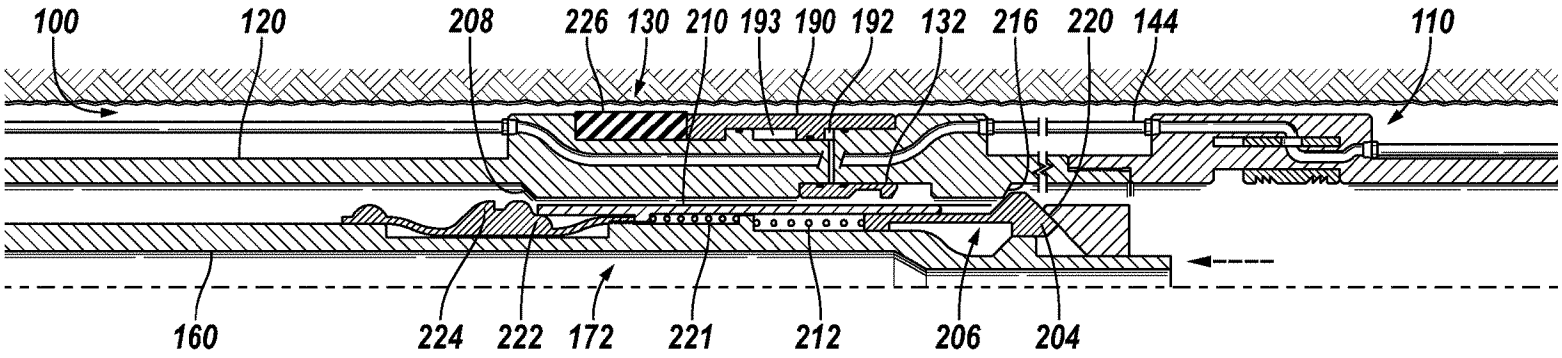

FIGS. 11 and 12 depict cross-sectional views of a portion of the downhole tool 110 with the zonal isolation packer shifting tool 172 shifting from a deactivated state to an activate state, according to one or more embodiments disclosed. Once the activation collet 206 moves past the restriction 208 of the zonal isolation packer 130, the spring member 212 may shift the activation collet 206 back to a position in which collet fingers 204 extend radially-outward from the deactivation sleeve 210, as illustrated in FIG. 11. The inner tubular member 160 may then be pulled upwardly relative to outer tubular member 120 (e.g., to the left as shown in the Figures), causing the zonal isolation packer shifting tool 172 to transition from the deactivated state to an activated state, as illustrated in FIG. 12. This relative upward movement of the inner tubular member 160 causes the collet fingers 204 to engage a second restriction 216 located on, for example, a bottom or downhole side of the zonal isolation packer 130.

Figure 13:
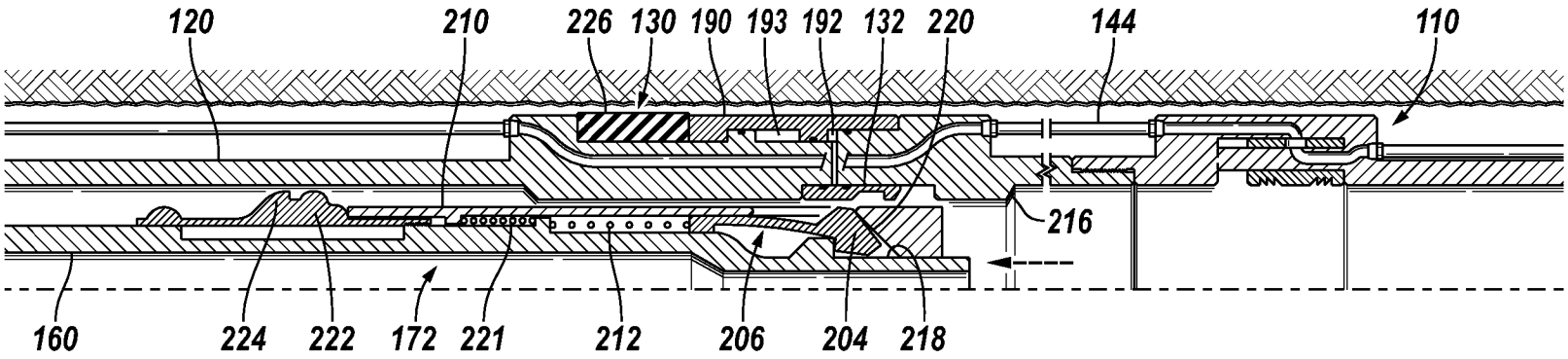
FIGS. 13-15 depict cross-sectional views of a portion of the downhole tool with the shifting member engaging and moving the sleeve from a closed position to an open position, according to one or more embodiments disclosed.
Figure 14:
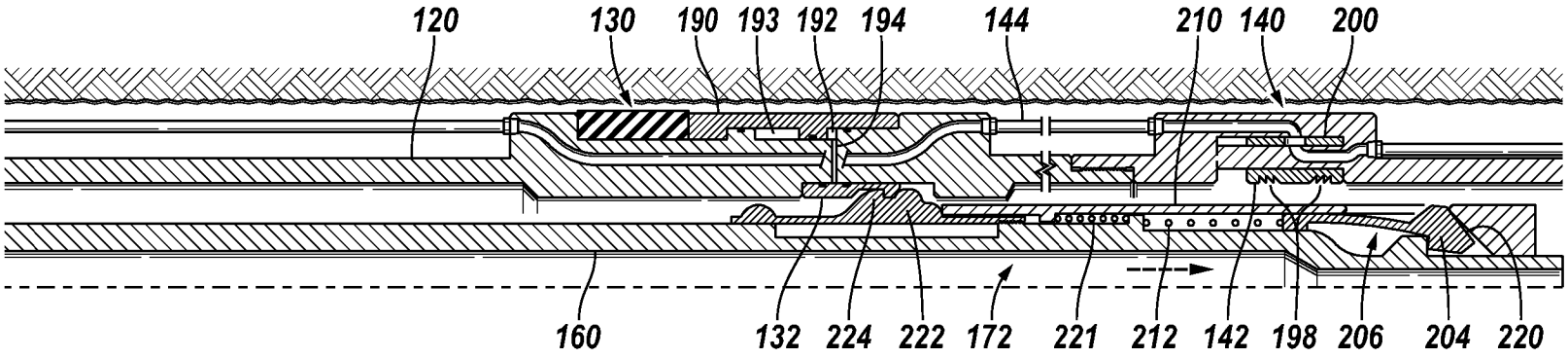
Figure 15:
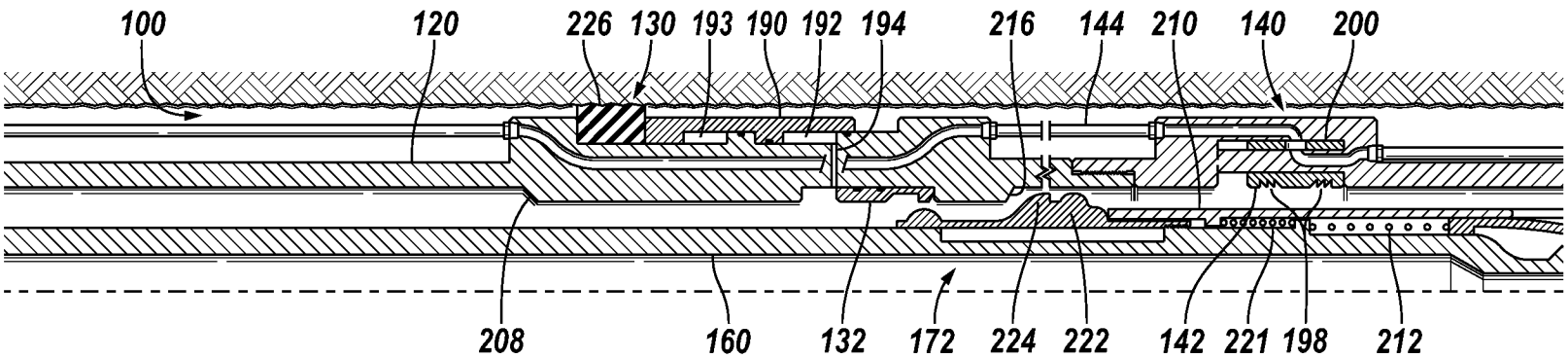

FIGS. 13-15 depict cross-sectional views of a portion of the downhole tool 110 with the shifting member 224 engaging and moving the sleeve 132 from a closed position to an open position, according to one or more embodiments disclosed. Referring to FIG. 13, continued relative upward movement of the inner tubular member 160 (while the collet fingers 204 engage the second restriction 216) may cause the activation collet 206 to move or be stretched axially-downward relative to inner tubular member 160. As a result, the collet fingers 204 may be forced radially-inward into a landing 218 which may be in the form of a groove or recess formed in the body 161 of the inner tubular member 160. The collet fingers 204 may also have an engagement surface 220 (e.g., a sloped surface) designed to engage a corresponding surface of the deactivation sleeve 210. As the collet 206 shifts relative to the inner tubular member 160, the deactivation sleeve 210 may also be shifted due to the engagement surface 220. The shifting of the deactivation sleeve 210 may compress a spring 221. Additionally, the shifting of the deactivation sleeve 210 may cause a shifting collet 222 to release. The release of the shifting collet 222 transitions a shifting member 224 to a radially-outward position which allows the shifting member 224 to engage the sleeve 132 coupled to the zonal isolation packer 130.

Referring now to FIG. 14, the inner tubular member 160 may be again moved downwardly relative to the outer tubular member 120 (e.g., to the right as shown in the Figures), and the shifting member 224 may engage the sleeve 132 coupled to the zonal isolation packer 130. Continued relative downward movement of the inner tubular member 160 may cause the shifting member 224 to shift the sleeve 132 from the closed position (FIG. 14) to an open position (FIG. 15) which opens the port 194 so that higher pressure fluid may flow into the pressure chamber 192. The pressure of the fluid in the pressure chamber 192 may be higher than the pressure of the fluid stored in a pressure chamber 193. Therefore, the flow of fluid into the pressure chamber 192 may create a pressure differential across the activation piston 190, causing the activation piston 190 to shift against a flexible packer element 226 of the zonal isolation packer 130, as illustrated in FIG. 15.

The flexible packer element 226 may be squeezed by the activation piston 192 until the flexible packer element 226 expands radially-outward and contacts the surrounding wellbore wall to isolate the adjacent annular portions of the wellbore 100 from one another. Once the zonal isolation packer 130 is set and the shunt tube isolation valves 140 are opened, the gravel packing operation or other desired operation may be performed.

Figure 16:
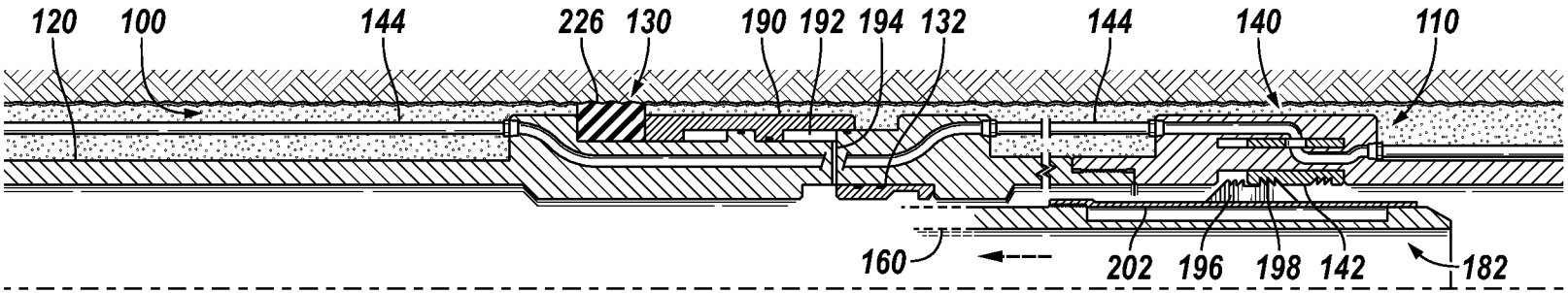
FIGS. 16 and 17 depict cross-sectional views of a portion of the downhole tool with the shunt tube isolation valve being shifted to a closed position, according to one or more embodiments disclosed.
Figure 17:
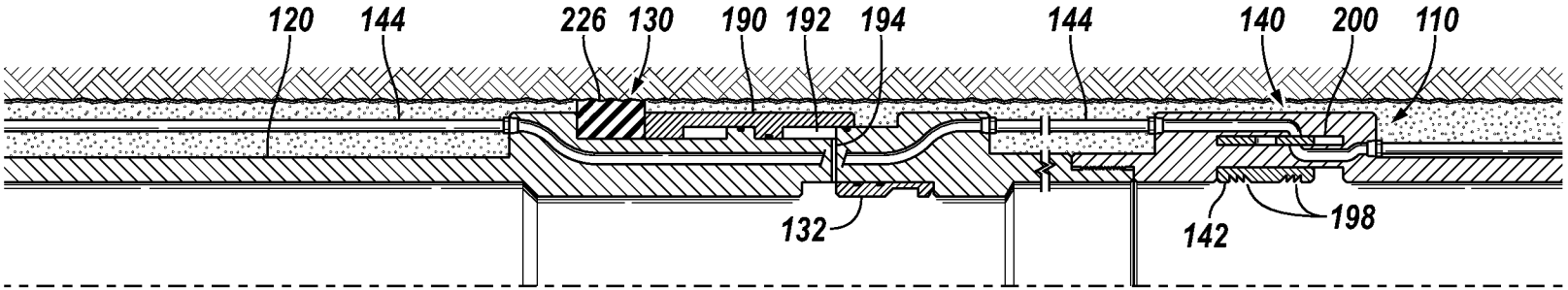

FIGS. 16 and 17 depict cross-sectional views of a portion of the downhole tool 110 with the shunt tube isolation valve 140 being shifted to a closed position, according to one or more embodiments disclosed. Once gravel packing has taken place, the shunt tube isolation valve 140 may be shifted to a closed position. For example, after the gravel pack has been pumped, the inner tubular member 160 may be moved in the upward direction (e.g., to the left as shown in the Figures), and the relative upward movement of the inner tubular member 160 may be used to close the shunt tube isolation valve 140. As illustrated in FIG. 16, the relative upward movement of inner tubular member 160 causes the engagement features 196 to again engage the sleeve 142 coupled to the shunt tube isolation valve 140 via another portion of the corresponding engagement feature 198. The upward movement of the inner tubular member 160 relative to the outer tubular member 120 may cause the sleeve 142 to shift to a closed position, as illustrated in FIG. 17. Continued upward movement of the inner tubular member 160 causes the engagement feature 196 to release from the corresponding engagement feature 198 as the flex member 202 bends or flexes radially-inward. When the inner tubular member 160 has been withdrawn from the wellbore 100, each of the shunt tube isolation valves 140 remains closed and the various gravel packing zones are isolated from each other.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although only a few example embodiments have been described in detail above, those skilled in the art will readily appreciate that many modifications are possible in the example embodiments without materially departing from "System and Method for Actuating Downhole Packers." Accordingly, all such modifications are intended to be included within the scope of this disclosure. Further, it is the express intention of the applicant not to invoke 35 U.S.C. §112(f) for any limitations of any of the claims herein, except for those in which the claim expressly uses the words 'means for' together with an associated function.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

What is claimed is:

1. A downhole tool, comprising:

an outer tubular member having one or more screens coupled thereto;

a packer coupled to the outer tubular member;

a first sleeve coupled to the packer and adapted to move from a first position to a second position, the packer actuating into a set state when the first sleeve is moved to the second position, the packer isolating first and second portions of an annulus from one another when in the set state;

a shunt tube coupled to the packer and providing a path of fluid communication from the first portion of the annulus, through the packer, and to the second portion of the annulus when the packer is in the set state;

a shunt tube isolation valve coupled to outer tubular member and the shunt tube;

a second sleeve coupled to the shunt tube isolation valve and adapted to move from a first position to a second position, the shunt tube isolation valve blocking the path of fluid communication from the first portion of the annulus to the second portion of the annulus when the second sleeve is in the second position;

an inner tubular member disposed radially-inward from the outer tubular member;

a first shifting tool coupled to the inner tubular member and adapted to engage and move the first sleeve from the first position to the second position; and a second shifting tool coupled to the inner tubular member and adapted to engage and move the second sleeve from the first position to the second position;

wherein the first shifting tool is actuated from a deactivated state to an activated state when the inner tubular member moves upward, and the first shifting tool moves past and contacts a restriction within the outer tubular member.

2. The downhole tool of claim 1, wherein the packer actuates into the set state as a result of a hydrostatic force applied when the first sleeve is moved to the second position.

3. The downhole tool of claim 1, wherein the first shifting tool is unable to actuate the packer when the first shifting tool is in the deactivated state.

4. The downhole tool of claim 3, wherein the packer is actuated into the set state when the inner tubular member moves downward, and the first shifting tool engages and moves the first sleeve into the second position while in the activated state.

5. The downhole tool of claim 1, wherein the outer tubular member comprises at least part of a completion assembly, and wherein the inner tubular member comprises a wash pipe.

6. A method for gravel packing a wellbore in a single trip, comprising:

deploying a downhole tool into the wellbore, the downhole tool including:

an outer tubular member having one or more screens coupled thereto;

a plurality of packers coupled to the outer tubular member;

a plurality of first sleeves, each first sleeve coupled to a corresponding packer;

an inner tubular member disposed radially-inward from the outer tubular member; and a plurality of first shifting tools coupled to the inner tubular member;

moving the inner tubular member in a first axial direction with respect to the outer tubular member, wherein the first shifting tools each contact a corresponding restriction in response to the movement in the first direction, and wherein the first shifting tools actuate from a deactivated state to an activated state in response to the contact;

moving the inner tubular member in a second, opposing axial direction with respect to the outer tubular member after the first shifting tools are actuated into the activated state, wherein the first shifting tools engage and move the first sleeves from a first position to a second position in response to the movement in the second direction, wherein the packers actuate from an unset state to a set state when the first sleeves move into the second position, and wherein a first one of the packers isolates first and second portions of an annulus from one another when in the set state; and performing a treatment to the first portion of the annulus after the first packer is actuated into the set state.

7. The method of claim 6, wherein the first shifting tools are unable to actuate the packers when the first shifting tools are in the activated state while the inner tubular member is moving in the first direction.

8. The method of claim 6, wherein the treatment comprises gravel packing, acid treatment, fracturing, or a combination thereof.

9. The method of claim 6, wherein performing the treatment comprises pumping a gravel slurry from the first portion of the annulus to the second portion of the annulus via a shunt tube that extends through the packer.

10. The method of claim 9, wherein the outer tubular member further includes a shunt tube isolation valve coupled thereto, and wherein the inner tubular member further includes a second shifting tool coupled thereto.

11. The method of claim 10, further comprising moving the inner tubular member in the first direction after the packers are actuated into the set state causing the second shifting tool to engage and move a second sleeve coupled to the shunt tube isolation valve from a first position to a second position, wherein the shunt tube isolation valve is actuated from an open state into a closed state when the second sleeve moves to the second position, and wherein the shunt tube isolation valve prevents the gravel slurry from flowing from the first portion of the annulus to the second portion of the annulus via the shunt tube when the shunt tube isolation valve is in the closed state.

12. The method of claim 11, wherein the first shifting tools are actuated into the activated state, the packers actuate into the set state, the gravel slurry flows into the first and second portions of the annulus, and the shunt tube isolation valve is actuated into the closed state during a single trip in the wellbore with the downhole tool.

13. The method of claim 6, wherein the packers actuate into the set state via hydrostatic force when the first sleeves are moved to the second position.

* * * * *